US005609111A

United States Patent [19]

Hasegawa et al.

[11] Patent Number: 5,609,111

[45] Date of Patent: Mar. 11, 1997

[54] RETURNABLE FRAMEWORK STRUCTURE

[75] Inventors: Nobutoshi Hasegawa; Yoshio Hirota; Sumio Nagase, all of Suzuka; Hisato Fukuta, Yokkaichi; Makoto Tani, Mie-ken, all of Japan

[73] Assignee: Honda Giken Kogyo Kabushiki Kaisha and Kabushiki Kaisha Honda Express, Japan

[21] Appl. No.: 415,997

[22] Filed: Apr. 4, 1995

[30] Foreign Application Priority Data

Apr. 5, 1994 [JP] Japan ..... 6-067493
Apr. 5, 1994 [JP] Japan ..... 6-067494

[51] Int. Cl.[6] ..... B65D 19/00

[52] U.S. Cl. ..... 108/55.1; 206/600

[58] Field of Search ..... 206/600; 108/51.1, 108/53.1, 56.1, 56.3

[56] References Cited

U.S. PATENT DOCUMENTS 5,381,915 1/1995 Yardley ..... 206/600

FOREIGN PATENT DOCUMENTS 2123789 2/1984 United Kingdom ..... 206/600

*Primary Examiner*—Peter M. Cuomo
*Assistant Examiner*—Gerald A. Anderson
*Attorney, Agent, or Firm*—Dickstein Shapiro Morin & Oshinsky LLP

[57] ABSTRACT

A returnable framework structure for freight transportation capable of being assembled and disassembled in a simple manner. The structures are provided with sufficient structural strength, and are stable when disassembled structures are stacked. A plurality of frame elements are assembled on a rectangular skid, which forms the bottom surface of the structure, along the edges of the skid. An L-shaped corner guide is secured to each corner area of the skid, and the frames are fixed to the corner guides by screw members. On the upper corners of each frame, L-shaped corner guides are secured. The corner guides are secured to the other frames by screw members. The corner guides are secured to the skid in the direction perpendicular to the direction they are secured to the frame.

6 Claims, 14 Drawing Sheets

RETURNABLE FRAMEWORK STRUCTURE

BACKGROUND OF THE INVENTION

1. Field of the Invention

The present invention involves a returnable framework structure capable of being easily assembled and disassembled, and more particularly to a returnable framework structure for enclosing loads and transporting packaged freight. The returnable framework structure is returned, after being evacuated and disassembled, to the site of reloading to be reused after being reassembled.

2. Brief Description of the Prior Art

An example of a returnable structure, shown in FIG. 18 as an exploded perspective view, includes a skid 70 forming a bottom, support frames 71 disposed in front and rear of the skid 70, and side frames 72 on left and right sides. A top frame 74 connects the side of the frames. The structure is assembled with frames which are tightened by means of bolts at a packaging site.

When conventional returnable structures are returned in a container or the like, each component can not be enclosed in compact form, and therefore it is difficult to return a number of structures without occupying a large space. Also, nuts to be fastened with bolts are welded on each retaining position. As each frame is tightened by bolts, a period of time and labor are inevitably required for setting and removing a necessary number of bolts. This operation can not be performed by a single person.

Also, in conventional structures the stability of a number of returnable structures stacked upon each other is not always satisfactory.

SUMMARY OF THE INVENTION

An object of the present invention is to provide a returnable structure capable of being easily assembled and disassembled with a minimized operation time. The mechanical strength of the assembled structure is maintained, and the structure can be assembled and disassembled even by a single person.

Another object of the present invention is to provide a returnable structure whose condition when packed after being disassembled is extremely minimized, and whose condition when freighted is excellently maintained and stabilized even when structures are stacked on top of each other.

The above objects of the invention are accomplished by the invention, for example, in which the construction of a returnable structure includes a skid which forms a bottom surface and four rectangular frames each mounted on an edge of the skid. An L-shaped corner guide is secured at each corner of the skid having a plate-like portion along the first direction of the edges of the skid and another plate-like portion along the second direction transverse to the first direction of the edges of the skid. On the plate-like portion along the first direction mentioned above, a lower portion of each frame along the first direction is secured from the direction perpendicular to the first direction by means of a screw member. Also, on the flat portion of the corner guide along the second direction, the top end of the frame along the second direction is secured by means of a screw member from the direction perpendicular to the second direction.

Another aspect of the present invention provides a returnable structure in which a projection adapted to extend over the upper surface of the structure when disassembled is provided, and a recessed receiving portion is provided in the lower portion of the skid in the position associated with the projection mentioned above.

A further aspect of the invention is that screw members are meshed with the retainer plates provided at corners of the frame. The retainers are secured by welding such that the retainer is allowed to be included within the thickness of the frame.

Still another aspect of the invention is that each screw member is meshed with a clip nut by means of a screw retainer. The retainer is welded such that the clip nut is allowed to be included within the thickness of the frame.

A still further aspect of the invention is that the frame includes upper and lower elements in parallel with each other, and a pair of support members. Also a number of movement preventing patches are attached, at least at the end and intermediate positions, for keeping the frame in an upright position. The movement preventing patches are arranged in staggered relationship both inside and outside along each edge of the frame, and the height of at least the centrally arranged patch is higher than that of the lower frame element.

A still further aspect of the invention is that the frame includes upper and lower elements in parallel with each other, and a pair of support members. Also, a number of movement preventing patches, attached at least at the ends and the intermediate position, for keeping the frame in an upright position are arranged in staggered relationship both inside and outside along each edge of the frame. The lower end of the support extends downwardly beyond the Lower element, and the amount of such extension is longer then the distance between the inside patch and the outside edge of the skid.

A still further aspect of the invention is that height of the intermediately positioned patches is higher than that of the lower frames.

DETAILED DESCRIPTION OF THE PREFERRED EMBODIMENTS

Figure 1:
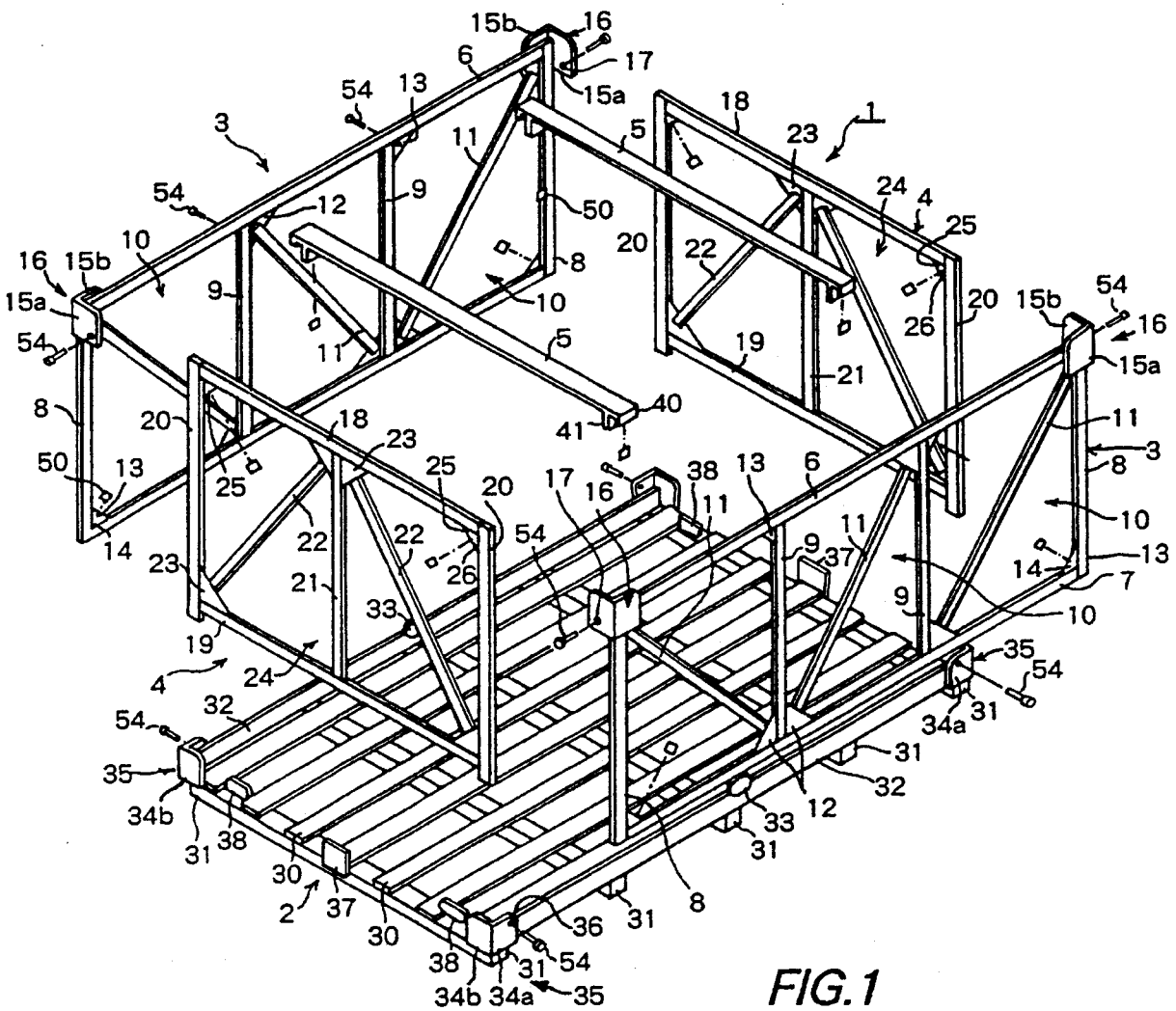
FIG. 1 is an exploded perspective view of a returnable framework structure according to the present invention.
Figure 2:
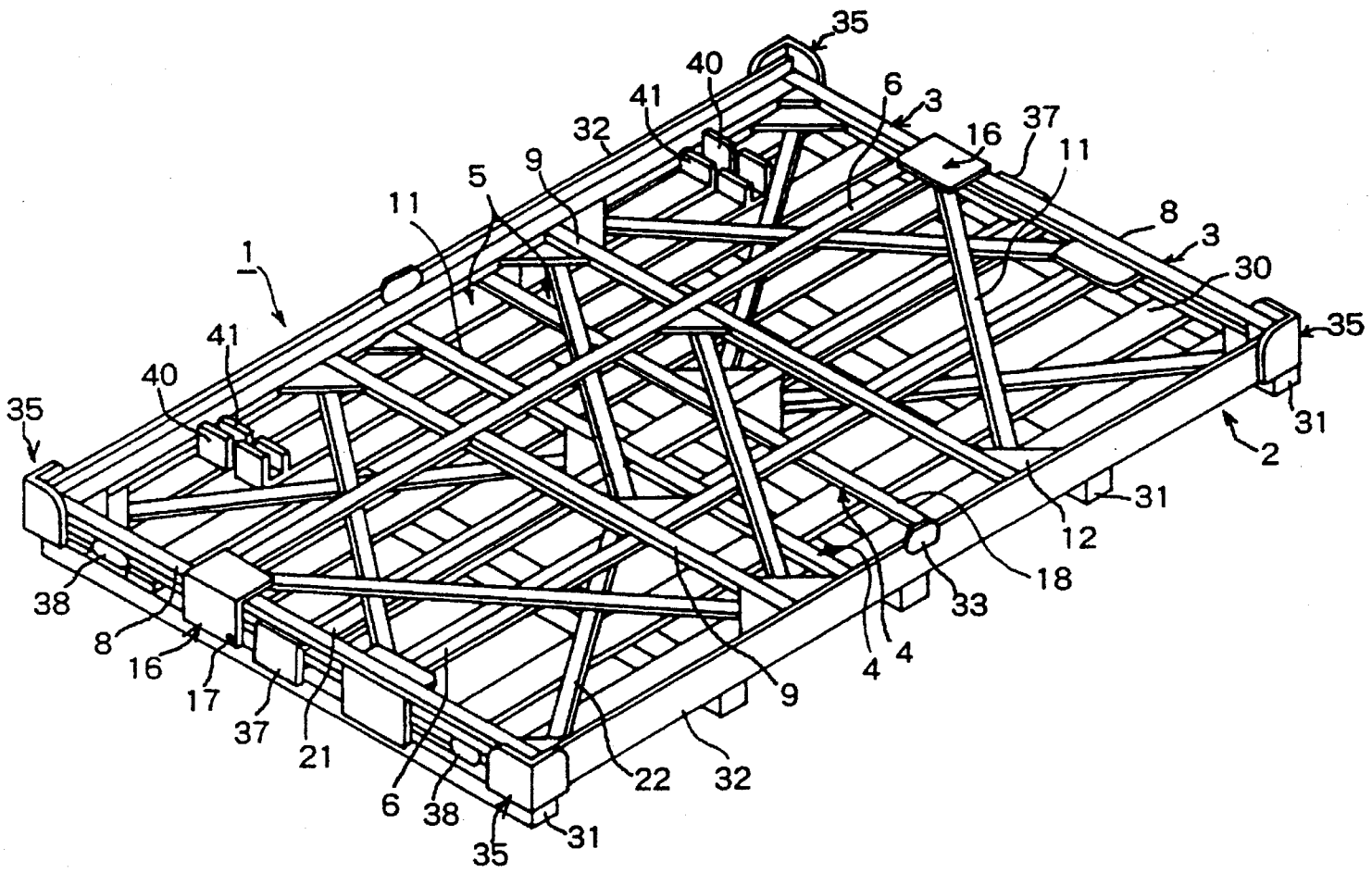
FIG. 2 is a perspective view of a disassembled structure in FIG. 1.
Figure 3:
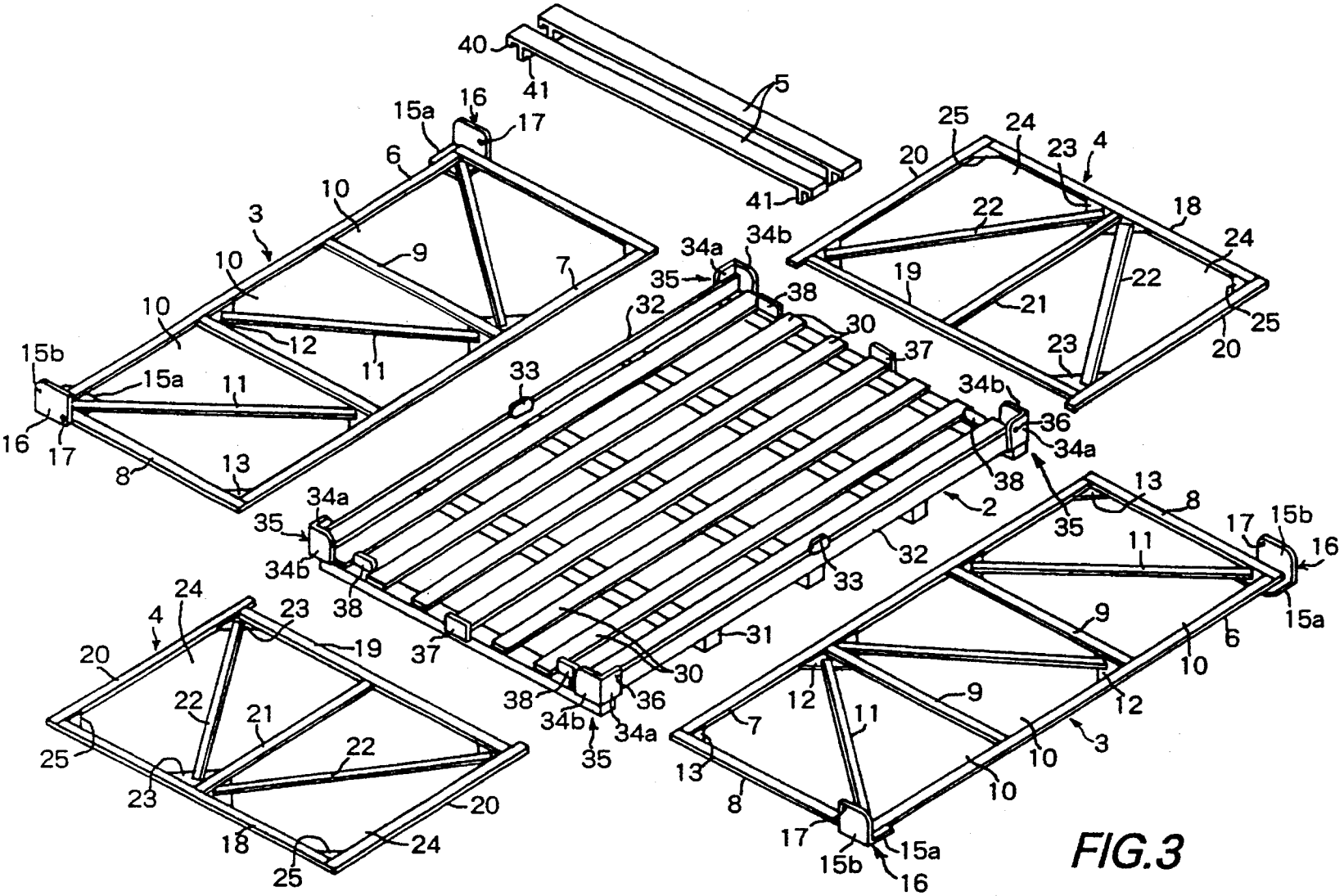
FIG. 3 is an exploded perspective view of components of the structure.
Figure 4:
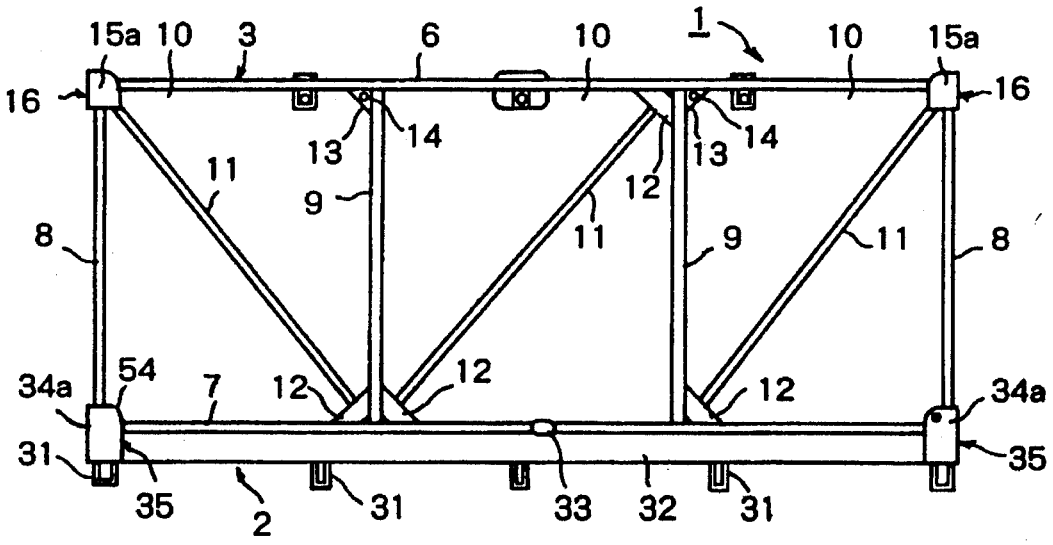
FIG. 4 is a side view of an assembled structure.
Figure 5:
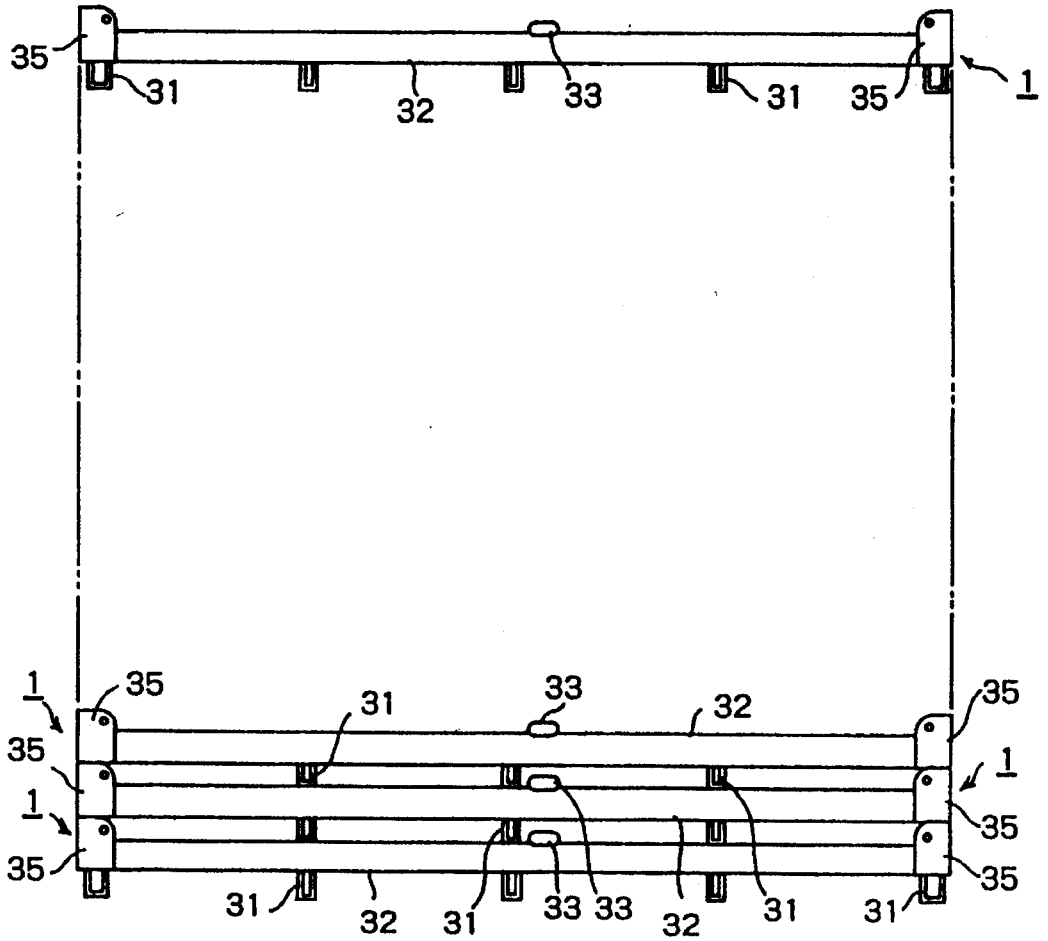
FIG. 5 is a side view of a plurality of disassembled structures which are stacked upon each other according to an embodiment of the present invention.
Figure 6:
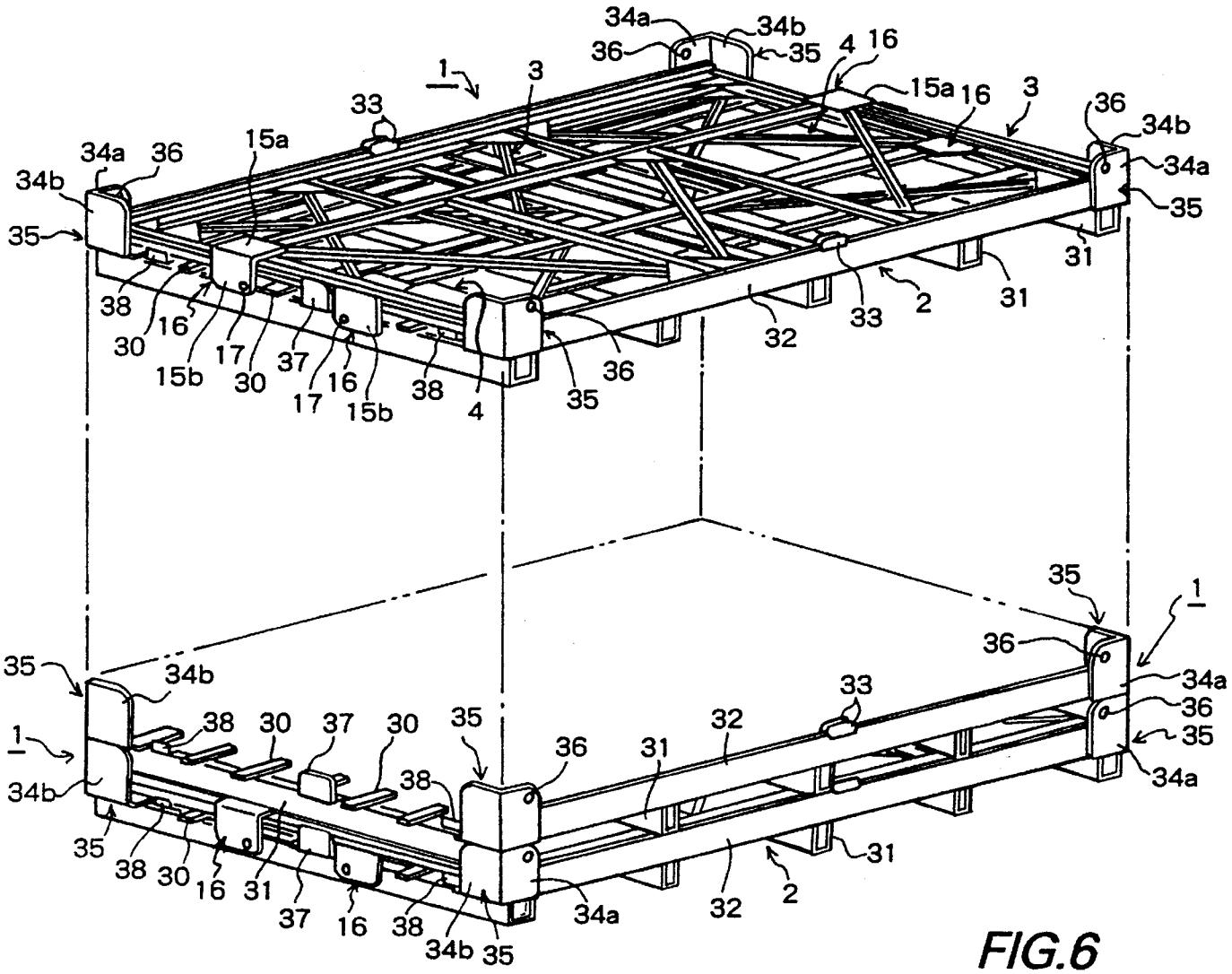
FIG. 6 is a perspective view of disassembled structures which are stacked upon each other according to another embodiment of the present invention.

Referring to FIG. 1, a returnable structure 1 includes, as principal components, a skid 2 forming a bottom surface, a pair of major frames 3 and minor frames 4, and a pair of guard members 5 detachably bridged laterally above the major frames 3.

A major frame 3 is composed of an upper element 6, bottom element and a corner support 8, all of which are assembled to form a rectangular configuration. Between upper frame element 6 and bottom element 7, a plurality of, such as two or more, reinforcing supports 9 are mounted in parallel with the corner supports 8. On each rectangularly formed section 10, a diagonal stiffener truss is connected through a trapezoidal reinforcing plate 12. At a corner having no reinforcing plate 12, a small-sized retainer plate 13 is secured by welding. In the middle of plate 13 is an aperture 14 for receiving a bolt.

In addition, at the upper corner of a major frame 3, accordingly at the upper end of corner support 8, an L-shaped corner guide 16 having a plate portion **15*a* and another plate portion is welded. The plate portions are respectively directed in the direction of each surface of the major and minor frames. On the lower region of plate portion 15*b* facing the surface of minor frame 4, apertures 17** for receiving bolts are formed.

A minor frame 4 having a construction generally identical to the major frame 3, includes an upper frame 18, bottom frame 19 and corner support 20, all of which are interconnected in a rectangular form. The minor frame also includes reinforcement supports 21, stiffener trusses 22 and retainer plates 23 connected by welding. In the case of the minor frame 4, reinforcement supports 21 form framed sections 24 on opposite sides, and at each corner area a trapezoidal retainer plate 25 is secured by welding.

In addition, an end of each corner support 20 extends further downwardly, the extension being slightly longer than the width of a foot member 31 of skid 2.

On the skid 2, a plurality of, such as two or more, spaced slide members 30 are arranged. On the lower surface of member 30 the foot members 31 mentioned above are secured with an equal space therebetween. Further, along the longer side on which the major frame 3 is placed, headers 32, each formed of a rectangular member, are secured so that the longitudinal direction of its section can take an upright position. Also, in the middle of the header 32, a pair of movement preventing patches 33, each formed as an elliptic plate, are secured interposed with headers 32.

At each corner of the skid 2, a corner guide 35 with a dimension higher than the header 32 is secured. On the side of corner guide 35 directed in the longitudinal direction of skid 2, accordingly above the plate member **34*a* on the side where the major frame 3** is mounted, a plurality of bolt receiving apertures are formed.

On the upper surface of foot member 31 at the two sides of skid 2, a displacement preventing patch 37 is centrally secured and other patches 38 are secured at both ends. The central patch 37 is positioned inside the foot member 31, while end patches 38 are outside the foot member 31. Accordingly, patches 37 and 38 are arranged in a staggered manner, so that each minor frame 4 is interposed between patches 37 and 38 and therefore enabled to take an upright position. The central patch 37 especially is formed higher than the width of bottom element 19, but lower than the corner guide 35.

A guard member 5 is a longitudinal member, and adjacent each of the ends there is integrally formed a minor engagement member 40 to engage with the upper element 6, and a major engagement member 41 to engage with a retainer plate 13 of the major frame 3.

Figure 7:
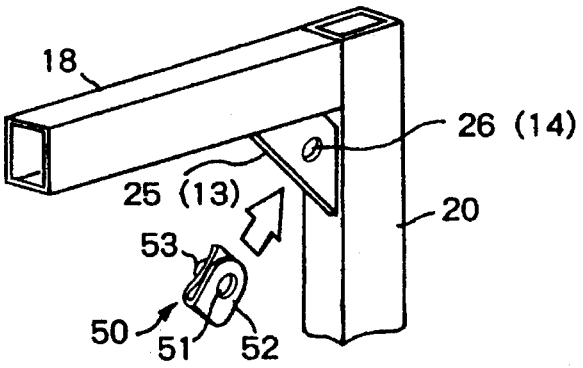
FIG. 7 is an enlarged perspective view of a clip nut.
Figure 8:
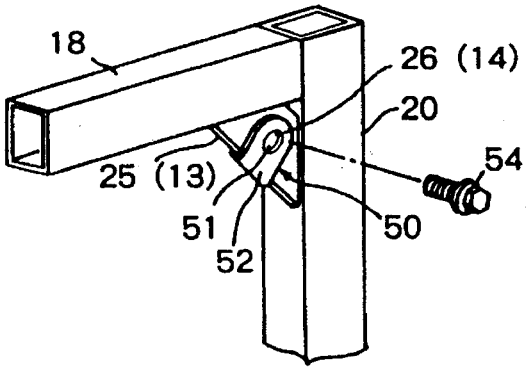
FIG. 8 is an enlarged perspective view of a clip nut installed on a retainer plate.
Figure 9:
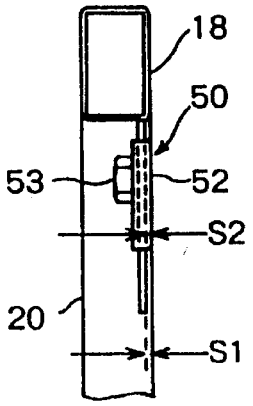
FIG. 9 is an illustrative view of a clip nut in relation to a frame as in the first embodiment of the present invention.

Each component is connected to one another by means of bolt/nut coupling, the nut being preferably a clip nut 50 as shown in FIGS. 7–9, formed of a clip member 52, on which a nut 53 is welded so that its meshed hole coincides with a bolt insertion aperture 51. The clip member 52 holds the retainer plate 13 or 25, then a member, such as a corner guide 16, 35, which is to be secured to the opposite surface of the clip 53 is attached. Thereafter a bolt 54 is screwed into and tightened with the nut 53, so that all members are interconnected to each other.

Each of the trapezoidal retainers 13 and 25 are welded at each corner of the frame elements 10 and 24 of major and minor frames 3 and 4. The method of securing the retainers is described for the case of the corner formed by an upper frame element 18 of minor frame 4 and a corner support 20, as shown in FIGS. 7 to 9. The retainer plate 25 in the case above, whose inner and outer surfaces are flush with neither upper element 18 nor with the inner and outer surfaces of corner support 20, are positioned in the range of the thickness of upper element 18 and corner support 20, and positioned adjacent the outer side thereof. Further, even when the clip nut 50 is mounted on retainer plate 25, the clip member 52 is welded at the position where clip 52 would extend externally beyond neither upper element 18 nor corner support 20, and therefore not beyond minor frame 4. The stepped difference S1, formed by both the outer surface of minor frame 4 and that of retainer plate 25, is designed to be longer, and therefore deeper, than the thickness of clip member 52 which is coupled.

In the case of the embodiment above, especially elongated components may be formed of a hollow bar material having rectangular cross section. Namely, these include the components which are basic constituents of the major and minor frames, such as upper elements 6 and 18, bottom elements 7 and 19, corner supports 8 and 20, reinforcement supports 9 and 21, stiffeners 11 and 22, and guard members 5. Components other than the above include slide members 30, foot members 31 and headers 32, and these are also formed of hollow bars each having a rectangular cross section. Thus the light weight of the entire construction is achieved.

When assembling the structure 1, each of the retainer plates 13, 25 and 41 is in advance attached with a clip nut 50, respectively provided with a nut. 53 facing inside.

First Step of Assembly

On header 32 of the skid 2, a bottom element 7 of major frame 3 is interposed between a pair of shift preventing patches 33 to cause the frame 3 to take in an upright position.

A corner guide 26 and two retainer plates 13 are placed so that two bolt receiving apertures 36 are aligned with two apertures 51, respectively, and a bolt 54 is tightened with a nut 54 of clip nut 50, thereby securing one of major frames 3 to one of longitudinal edges of skid 2.

Second Step of Assembly

Each of minor frames 4 is retained in an upright position by placing a bottom element 19 of the frame 4 on foot member 31 between the patches 37 and 38. Then, one major frame 3, already kept upright, and the retainer plates 25 are attached together so that each corner guide 16 coincides with the corresponding bolt receiving aperture 26 and 52.

In such a manner, one major frame 3 and two minor frames 4 are mounted on the skid 2. Thereafter, from the remaining side yet to be installed with the other major frame 3, the freight to be transported, such as cardboard cases, is loaded and stacked on the skid 2.

Third Step of Assembly

The other major frame 3 is assembled in a similar manner, so that two guard members 20 are bridged in parallel with minor frames 4 and correspond to reinforcement support positions and both engagement positions 40.

Assembly of the structure 1 to enclose the freight is completed. A number of structures are stacked in a container using a forklift or the like and transported.

The returnable structure 1, after being transported and evacuated, is disassembled to a compact packed condition through the steps hereinafter described.

First Step of Disassembly

By releasing all the bolt joints, guard member 5 is removed but still the major and minor frames 3 and 4 are kept in their upright position. From this state, the pair of minor frames 4 are removed from the sustaining members 37 and 38, and tilted with respect to bottom element 19 to be allowed to fall down and placed such that the lower end of corner support 20 engages the plate portion **35*b* of corner guide 35. At this state, since the lower end of support 20 extends downwardly beyond the width of foot member 31, the minor frame 4 is closely engaged with the surface of the slide member 30 of skid 2 without being blocked by the shift preventing patches 38**.

Second Step of Disassembly

Two guard members 5 are placed on the skid 2 along the minor or major direction of skid 2.

Third Step of Disassembly

The pair of major frames 3 are thrown down by being turned around the bottom element 7 onto skid 2, and placed thereon such that the lower end of corner support 8 engages the plate portion **34*a* of corner guide 35. The thickness of members placed on skid 2 and the height of header 32 of skid 2 are selected so that each member does not extend beyond the height of header 32**.

Fourth Step of Disassembly

A number of packed disassembled framework components, collected within a minimized height in the way as described above, are stacked on the corner guide 35 and stored in a small space.

As stated above, the fastening by bolts 54 is performed in the different directions, namely perpendicular with each other, between the locations of upper and lower regions of the entire structure. Namely, at the lower region the corner guides 35 of skid 2 are fixed to the lower end of major frame 3; while, at the upper region the corner guides 16 of major frame 3 are fixed to the upper end of minor frame 4. Therefore, as compared to conventional structure in which two bolts are required to be tightened at each corner, the number of necessary bolts is largely reduced, as merely half the number of bolts are used. Further, the effect of bi-directional tightening provides the advantage that even a possible release of a bolt 54 in one direction would be effectively compensated by the fastening strength maintained with bolts 54 tightened in the other direction, thus providing improved structural strength.

A weldable area having a thickness increased by weld-acceptable material, formed at retainer members 13 and 25 used with bolts 54 for providing bolt fastening means, serves to perform welding from either the outer or inner direction of major and minor frames 3 and 4.

Also, as aforementioned, the clip member 52 is welded at the position where the clip 52 attached thereto would extend externally beyond frames 3 and 4. Thus the clip 52 is effectively prevented from being removed from the retainer plates 13 and 25, and coupling therebetween is reliably maintained.

In addition, the central patch 37, provided for the shift preventing purpose, is formed higher than the width of bottom frame member 19, which contributes to keeping the minor frame 4 in an upright position. This is a more stabilized condition, and facilitates assembly and disassembly operations, which can now be performed by a single person.

In the case of the following embodiment, those which are especially elongated components may be formed of a hollow bar material having a rectangular cross section. Namely, these include the components, which are basic constituents of major frames 3 and minor frames 4, such as upper elements 6 and 18, bottom elements 7 and 19, corner supports 8 and 20, reinforcement supports 9 and 21, stiffeners 11 and 22, and guide members 5. Those other than the above include slide members 30, foot members 31 and headers 32, and these are also formed of hollow bars each having a rectangular section, thereby the light weight structure of entire components being attempted.

Figure 10:
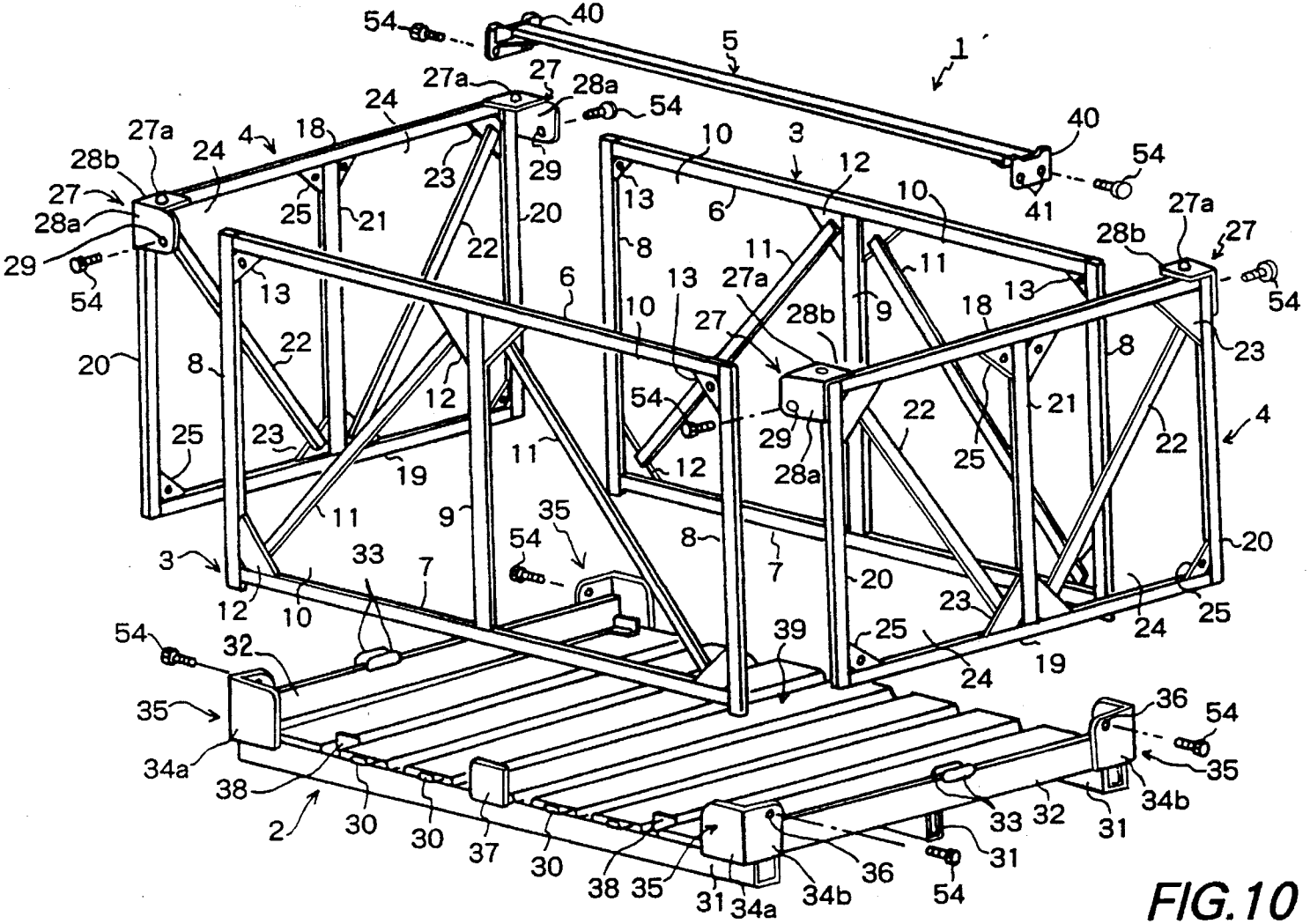
FIG. 10 is an exploded perspective view of a structure of the second embodiment of the present invention.
Figure 11:
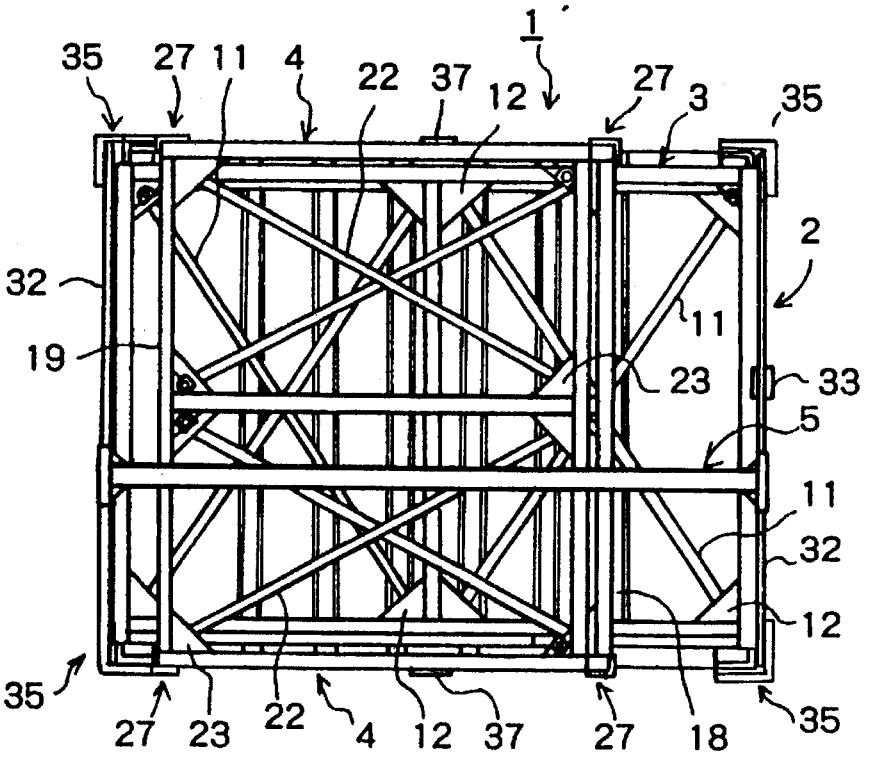
FIG. 11 is a plan view of a packed structure of the second embodiment of the present invention.
Figure 12:
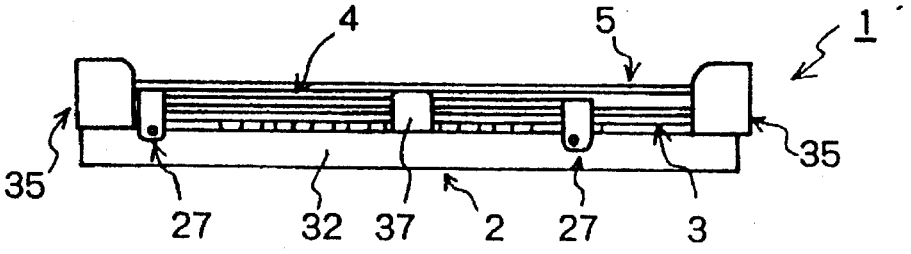
FIG. 12 is a side view of a packed structure of the second embodiment of the present invention.

Referring now to the second embodiment of the invention shown in FIGS. 10 to 12, a returnable framework structure 1' includes as principal components: a skid 2, respective pairs of major frames 3 and minor frames 4 each mounted on edges of the skid 2, and guard members 5.

In assembly of the structure 1', each retainer plate 13 and 25 is in advance attached with a clip nut 50 provided with a nut 53 facing inside.

First Step of Assembly

On the header of the skid 2, a bottom element 19 of major frame 3 is interposed between a pair of shift preventing patches 33 and placed to be retained in an upright position. A corner guide 35 and two retainer plates 13 are placed so that two bolt receiving apertures 36 are aligned with two apertures 51, respectively, and a bolt 54 is tightened with a nut 54 of the clip nut 50 to secure a minor frame 4 to a minor edge of skid 2.

Second Step of Assembly

Each of the major frames 3 is retained upright by placing a bottom element 7 of the major frame 3 on foot member 31 between the patches 37 and 38. Then, one minor frame 4 already kept upright and the retainer plates 13 are attached together so that each corner guide 27 coincides with the corresponding bolt receiving aperture 29 and 14.

In such a manner, one major frame 3 and two minor frames 4 are installed on the skid 2. Thereafter, from the remaining side to be installed with the other major frame 3, the freight to be transported, such as cardboard cases, is loaded and stacked on the skid 2.

Third Step of Assembly

The other major frame 3 is installed in a similar manner, such that two guard members 5 are bridged in parallel with major frames 3 and correspond to reinforcement support positions and both engagement positions 40.

As above, the returnable structure 1' is assembled with the freight enclosed therein, and a number of structures are stacked in a container or the like to be transported.

After transportation of the freight, the framework structure is disassembled to be collected in a small package, the method of which is described hereinafter.

First Step of Disassembly

By releasing all the bolt joints, guard members 5 are removed but the major frames 3 and minor frames 4 are kept upright. From this state, the pair of minor frames are removed from the sustaining members 37 and 38, and tilted around the bottom element 19 to fall down and be placed thereon such that the lower end of corner support 8 engages the plate portion 34*b* of corner guide 35. At this state, since the lower end of corner support 8 extends downwardly beyond the width of foot members 31, the minor frame 7 is closely engaged with the surface of the slide member 30 of skid 2 without being blocked by shift preventing patches 38.

Second Step of Disassembly

A pair of major frames 3 are thrown down around the side of bottom element 19, and stacked upon the skid 2, wherein the dimension of each member placed upon the skid 2 has been already designed so as not to exceed that of header 32 of skid 2.

Third Step of Disassembly

The pair of minor frames 4 are thrown down around the bottom element 19 onto skid 2, and placed thereon, wherein the thickness of each member placed on the skid 2 and height of header 32 of skid 2 are in advance selected so that each member does not extend beyond the height of header 32.

Fourth Step of Disassembly

Figure 13:
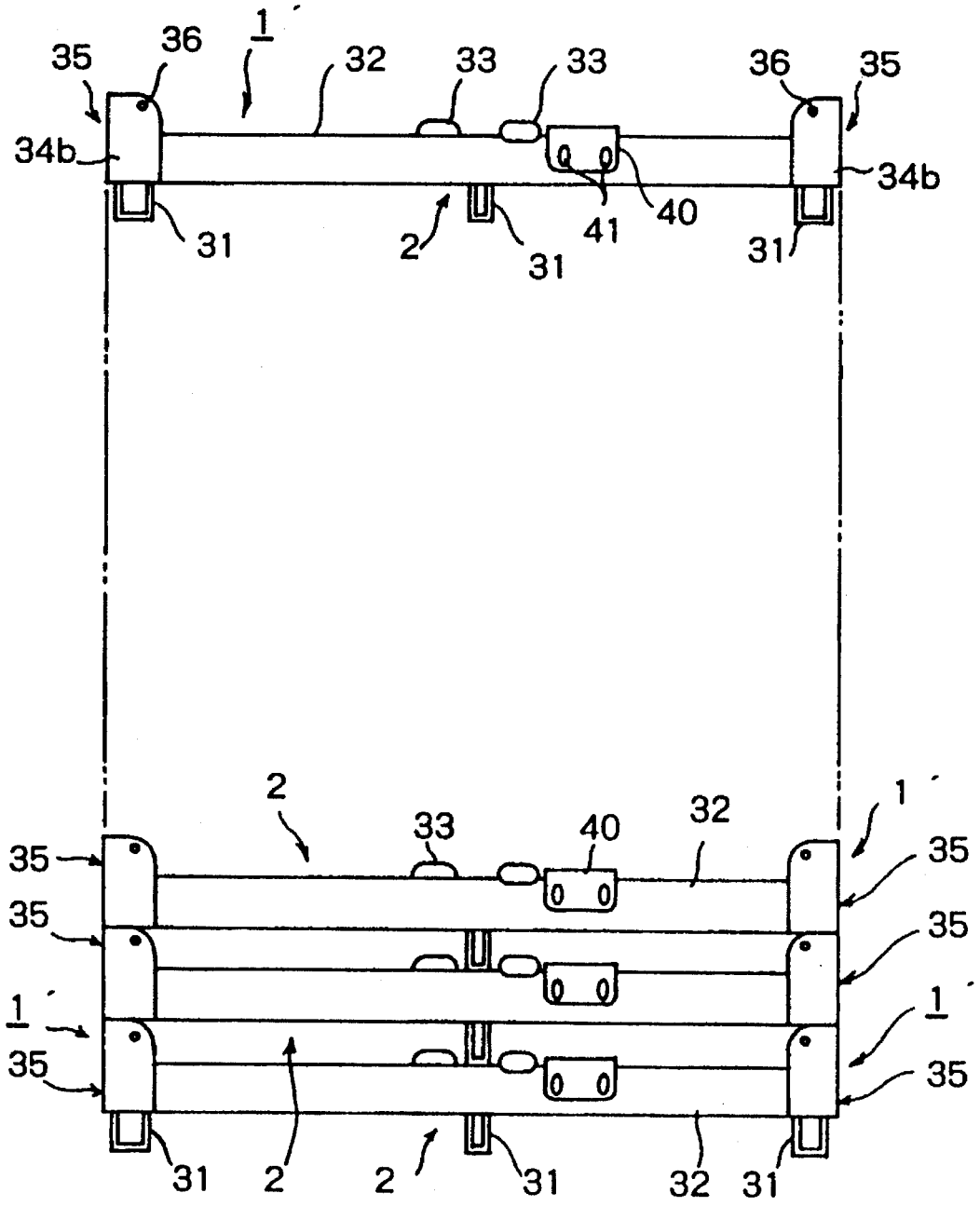
FIG. 13 is a front view of stacked and packed returnable structures of FIG. 12.
Figure 14:
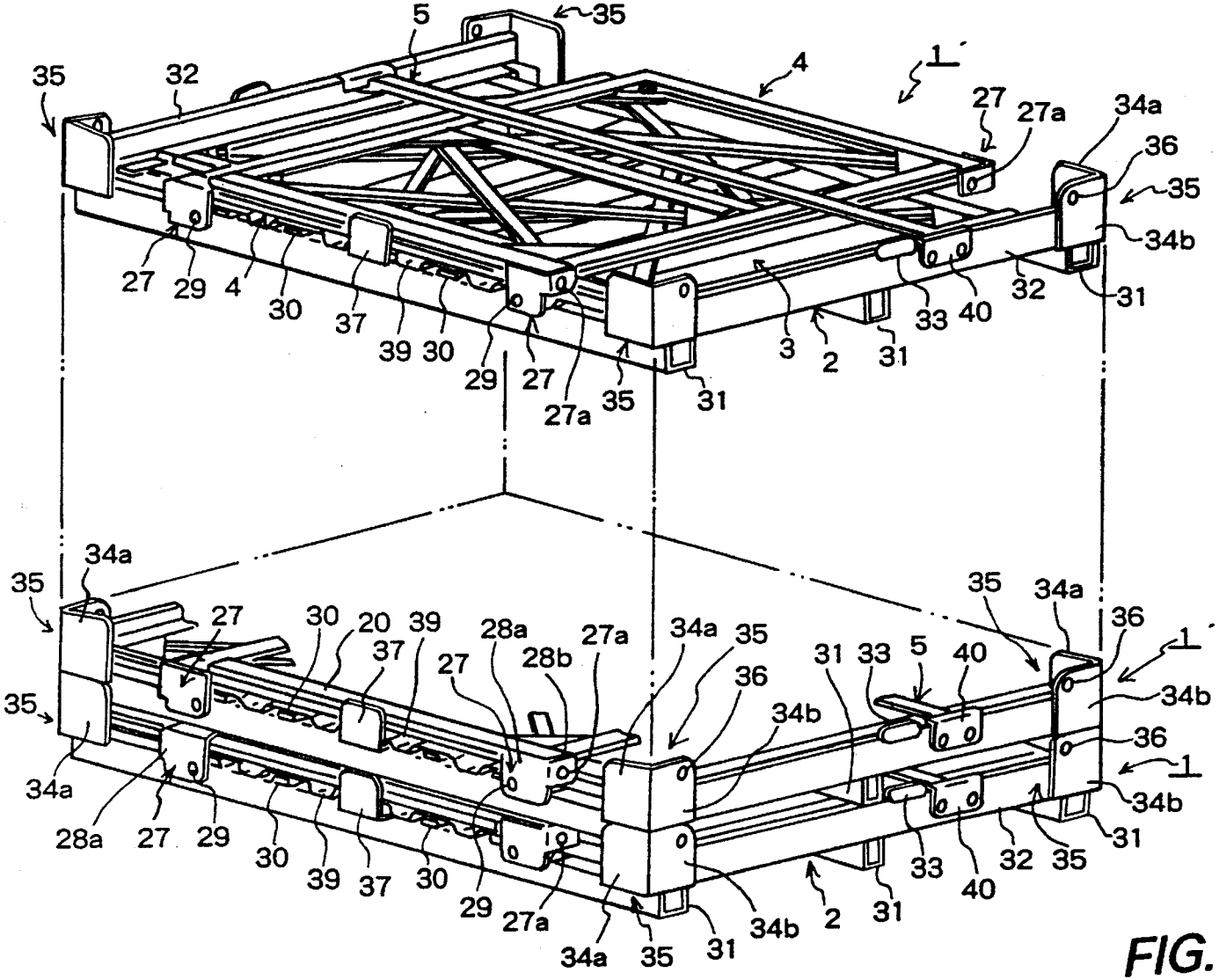
FIG. 14 is a perspective view of the stacked structures of FIG. 13.
Figure 15:
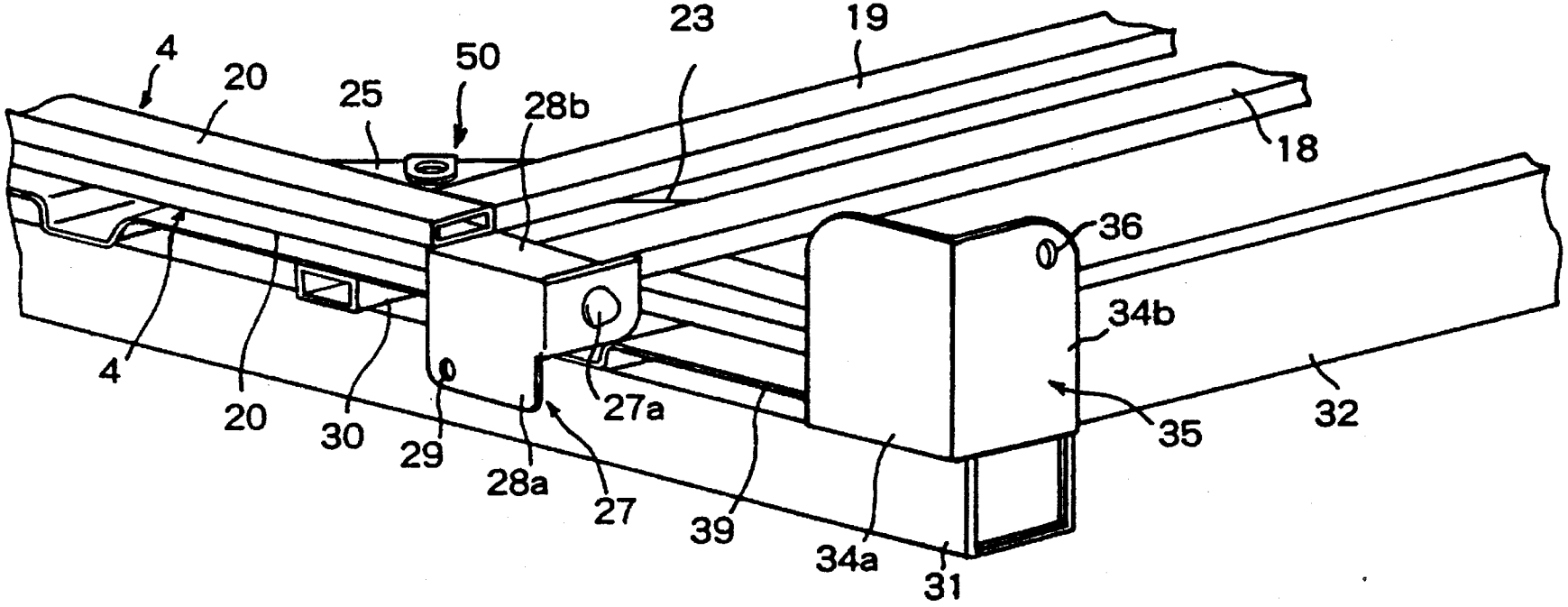
FIG. 15 is an enlarged perspective view of a corner guide having a projection.
Figure 16:
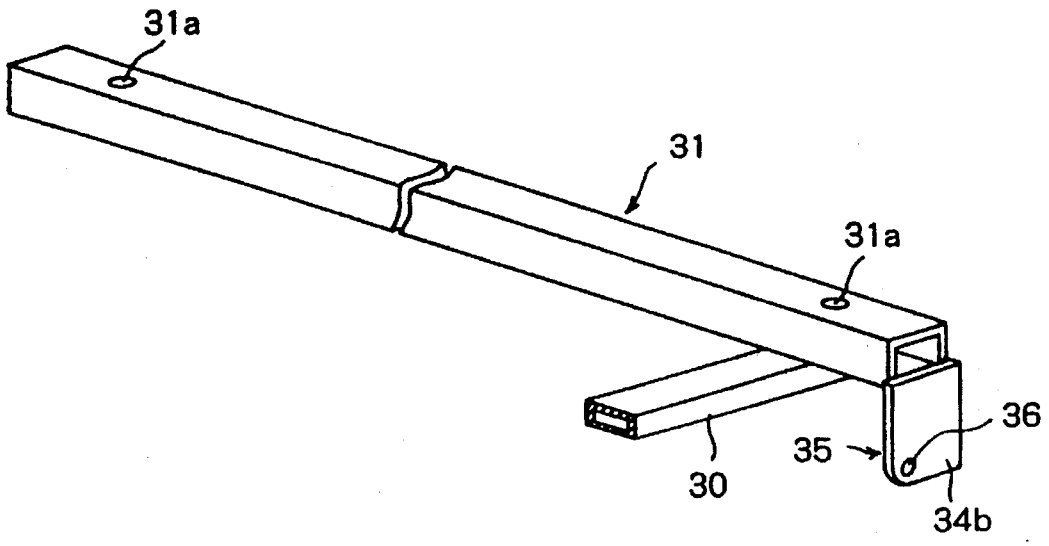
FIG. 16 is an enlarged perspective view of a foot member having a receiving aperture.

A number of packed disassembled framework components, as shown in FIGS. 13–14, collected with minimized height in the manner as described above, are stacked on the corner guide 35 and stored in a small space.

In accordance with the embodiment 1', when stacked at assembly time, projections 27*a* of corner guide 27 are fit with the apertures 31*a* formed at four corners on the bottom of foot member 31. Thereby such a stacked condition is satisfactorily maintained. The fitting structure of projections 27*a* with apertures 31*a* is also effective for realizing the following scheme.

Figure 17:
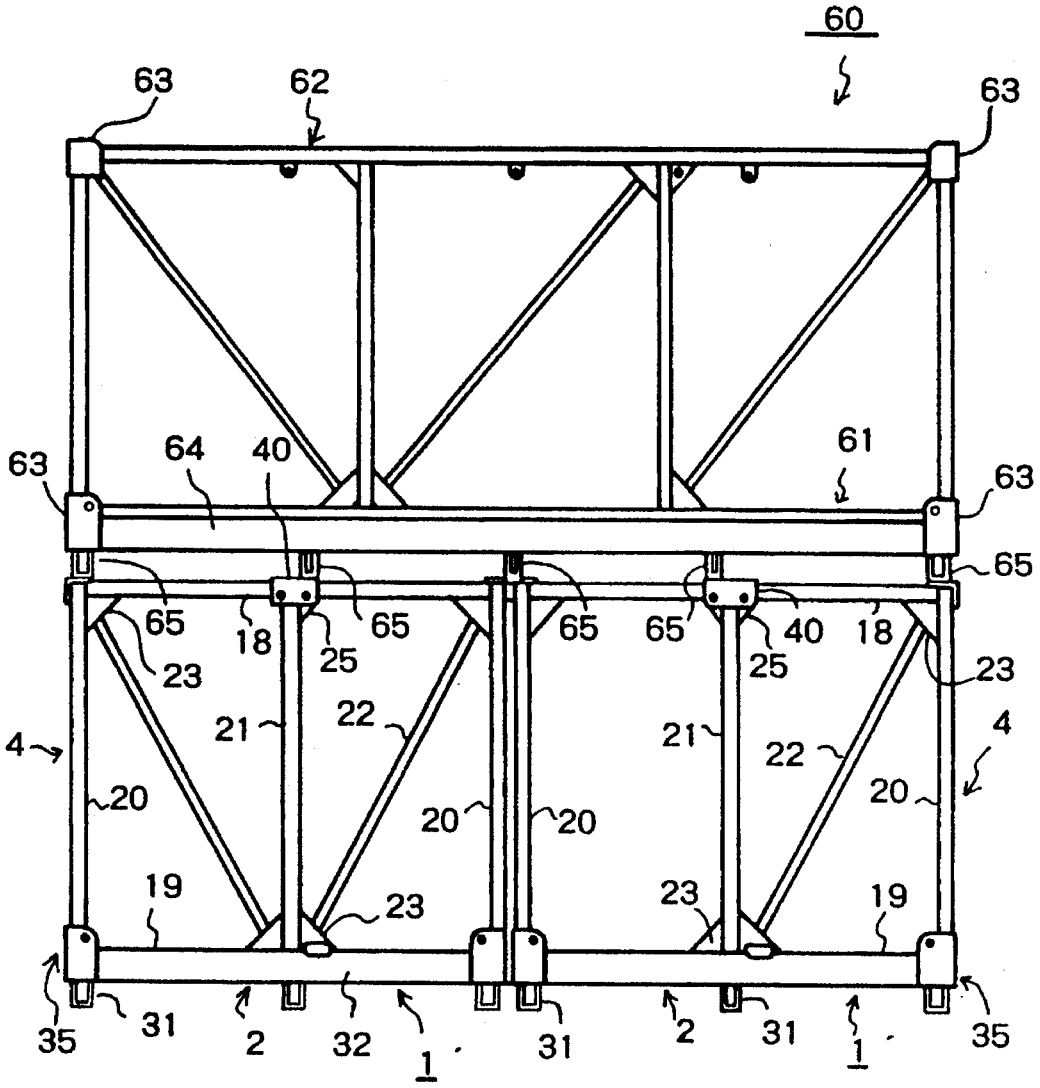
FIG. 17 is a side view of assembled returnable structures stacked in two steps.
Figure 18:
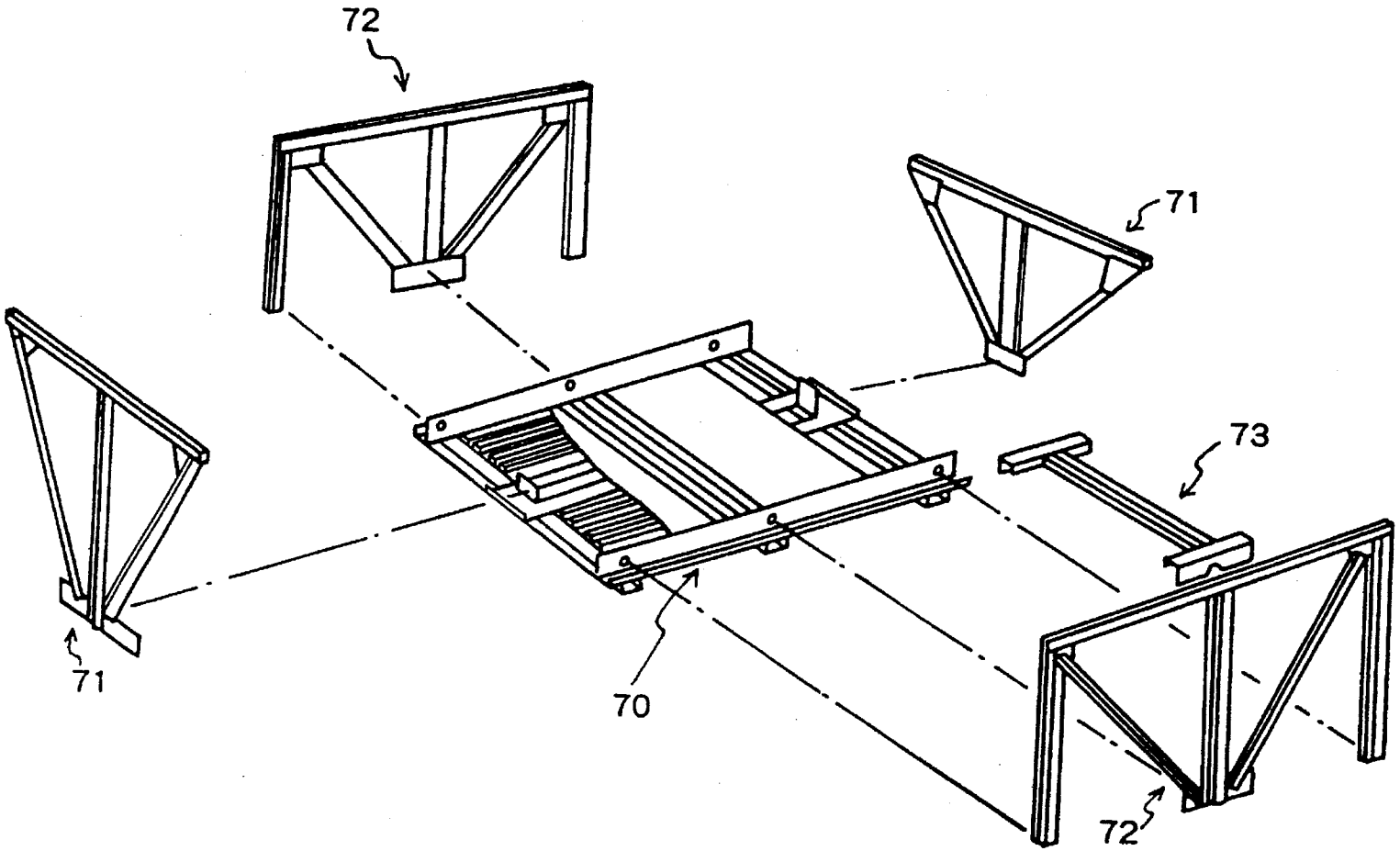
FIG. 18 is an exploded perspective view of a conventional returnable structure.

FIG. 17 shows a construction the same as the embodiment 1', but a structure 60 has a doubled length. FIG. 17 also shows an example of such a structure 60 stacked transversely on the juxtaposed two structures. By placing the structure 60 in the middle of the structure 1', stacking without being disturbed is possible. If the returnable structure 1' has corner guides on the upper surface as the structure 60 has, it becomes impossible to be stacked because such corner guides engage the header 64 of skid 61. In the present embodiment, however, corner guides do not extend beyond the top, which allows stacking of structures. In addition, as shown in FIG. 17, on the lower end of each of foot members 65, a receiving aperture is provided for receiving the projection 27*a*.

Further, in the embodiment 1', the central patch 37 for shift prevention is formed Higher than the width of the bottom frame member 19. This keeps the minor frame 4 in an upright position under a more stabilized condition, and facilitates assembly operation.

Further, when placing the major frame 3 onto skid 2, since the lower end of corner support 8 of major frame 3 extends downwardly beyond the width of foot member 31 of skid 2, the lower element 7 is not blocked by the inner shift preventing patches 38, but is rather positioned inside the end patches 38. Accordingly, the major frame 3 can be closely engaged with the surface of the deck plate 39 of skid 2.

Each of the components, including upper frame elements 6 and 18, bottom members 7 and 19, corner supports 8 and 20, etc., is formed of a hollow bar material having a rectangular cross section. Thus, a remarkably light weight of construction is realized.

What is claimed is:

1. A returnable framework structure transporting freight, comprising:

a rectangular skid formed as a bottom plate;

four frames, one said frame mounted along each edge of said skid perpendicular to said skid when said structure is assembled, and parallel to said skid when said structure is disassembled;

a first plurality of L-shaped corner guides each having a first flat portion extending in a first direction of said skid and another flat portion extending in a second direction transverse to said first direction of said skid; each said corner guide being secured to a corner of said skid;

a first end of two of said frames mounted in said first direction is secured to said first flat portion of one of said L-shaped corner guides by means of a screw retainer;

a second plurality of L-shaped corner guides each having a third flat portion extending in said first direction of said skid and fourth flat portion extending in said second direction transverse to said first direction of said skid each said corner guide being secured to corners of said frames opposite to said skid;

a second end of the other two of said frames mounted in said second direction is secured to said fourth flat portion of one of said second L-shaped corner guides secured to upper corners of said frames by means of a screw retainer;

said L-shaped corner guides acting as projections extending over an upper surface of said framework structure when said structure is disassembled; and a plurality of recessed receiving portions in lower portions of said skid in positions associated with said projections, such that said projections of one skid rest on said projections of a second skid when said one skid is stacked on said second skid.

2. A framework structure according to claim 1, wherein each of said frames has a plurality of parallel upper and lower frame elements and a pair of support members for interconnecting said upper and lower frame elements to each other; and wherein said framework structure further comprises:

a plurality of shift preventing patches for retaining each said frame in an upright position attached at each end of one edge of said frame and at an intermediate position of said edge, said patches being positioned alternately towards the inside of said structure and the outside of said structure; and said patches attached at said intermediate position extend away from said skid further than said lower frame elements.

3. A framework structure according to claim 1, wherein said screw retainer is connected with a retainer plate attached to a corner of said frame, and said retainer is secured by welding at a position at which said retainer is received.

4. A framework structure according to claim 1, wherein said screw retainer is connected with a clip nut which is attached so as to clip onto a retainer plate disposed at a corner of said frame and said retainer is secured by welding at a position at which said clip nut is received.

5. A framework structure according to claim 1, wherein said frames each include parallel upper frame elements and lower frame elements, and a pair of support members for interconnecting said upper and lower frame elements;

a plurality of shift preventing patches for retaining said frames in an upright position located alternately towards the inside of the structure and the outside of said structure on each end and intermediate positions of at least one side of said skid, each said support member extends downwardly below said lower frame element a distance greater than the distance between said shift preventing patches located towards the inside of said structure and the side of said skid towards the outside of said structure.

6. A framework structure according to claim 5, wherein the intermediately positioned patches extend away from said skid further than said lower frames.

* * * * *